United States Patent [19]

Elkin

[11] 4,201,347

[45] May 6, 1980

[54] CREMATORY ASH GRINDER

[75] Inventor: B. Jack Elkin, Santa Clara, Calif.

[73] Assignee: James D. McCampbell, Harbor City, Calif.

[21] Appl. No.: 962,131

[22] Filed: Nov. 20, 1978

[51] Int. Cl.[2] ..... B02C 7/12

[52] U.S. Cl. ..... 241/92; 241/95; 241/100; 241/285 B

[58] Field of Search ..... 144/176; 241/92, 100, 241/278 R, 285 A, 285 B, 95, 257 R, 259, 79.1

[56] References Cited

U.S. PATENT DOCUMENTS

| | | | |
|---|---|---|---|
| 1,638,416 | 8/1927 | Smith et al. | 241/92 X |
| 2,590,909 | 4/1952 | Westby et al. | 241/92 X |
| 2,856,976 | 10/1958 | MacDougall | 241/92 |

FOREIGN PATENT DOCUMENTS

| | | | |
|---|---|---|---|
| 2051576 | 5/1972 | Fed. Rep. of Germany | 241/79.1 |

*Primary Examiner*—Mark Rosenbaum

*Attorney, Agent, or Firm*—Fulwider, Patton, Rieber, Lee & Utecht

[57] ABSTRACT

A mechanism is provided for crushing and grinding cremated remains and includes a vertical cylindrical housing, a stationary bearing plate positioned transversely across the shaft defined within the housing, and a rotatable perforated grinding disk. The weight of the bearing plate crushes the crematory ashes as the grinding disk rotates, and the ground cremation remains fall through apertures in the grinding disk into a funnel for collection in an urn positioned below.

9 Claims, 6 Drawing Figures

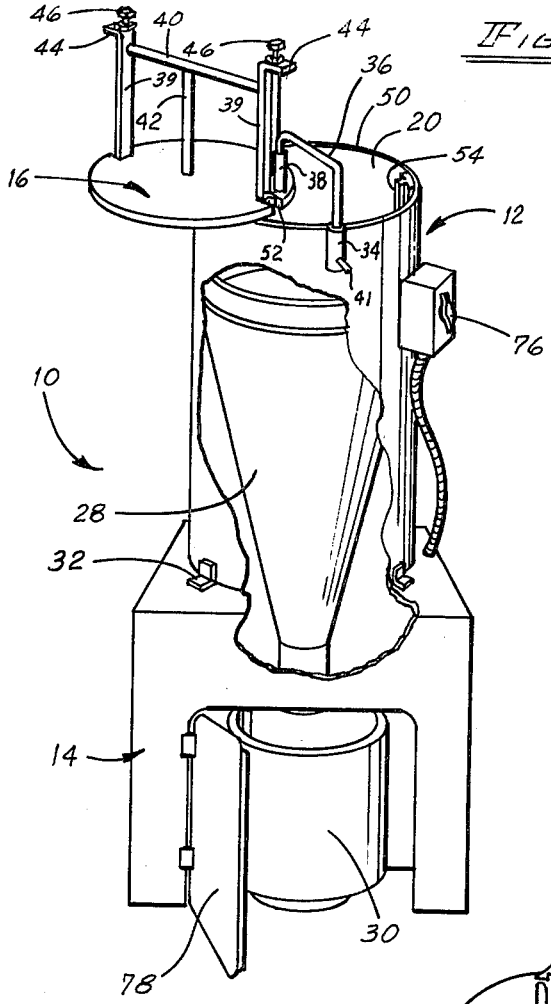
FIG. 1
FIG. 2
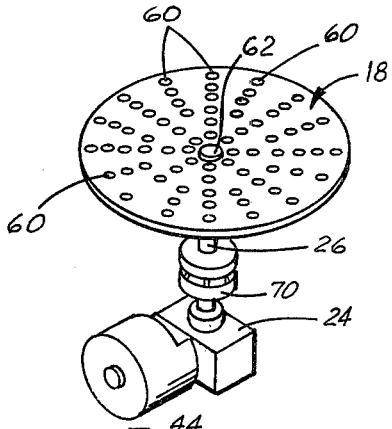
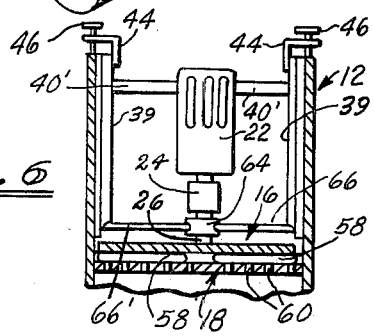
FIG. 6
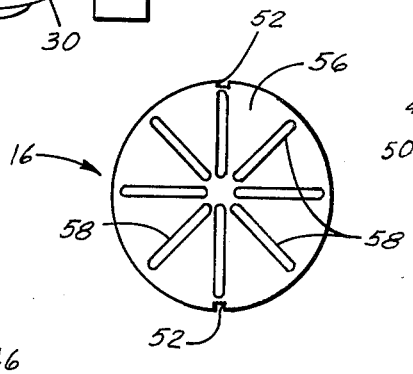
FIG. 5
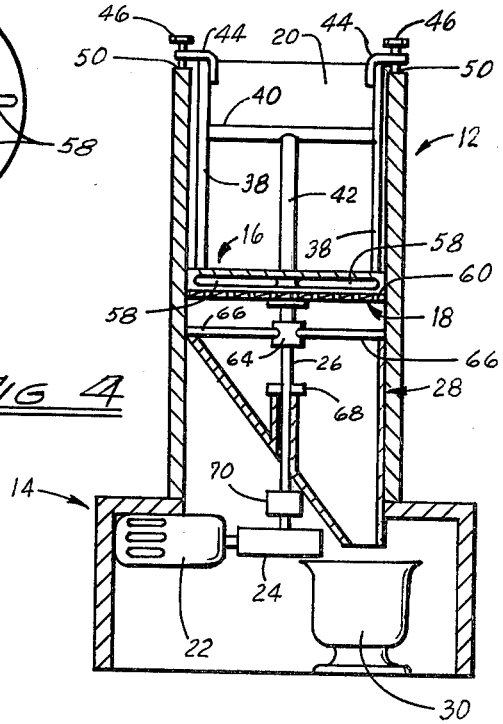
FIG 4
FIG. 3
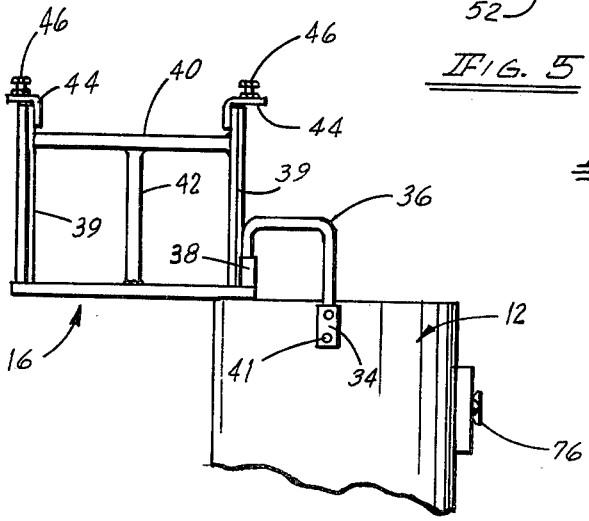

CREMATORY ASH GRINDER

BACKGROUND OF THE INVENTION

1. Field of the Invention

The present invention relates to devices used to process the remains of cremation for interment or disposal.

2. Description of the Prior Art

In the past, various devices have been utilized to process cremanted human remains for interment or for other permanent disposition. One device which presently is commercially available is a crematory ash pulverizer. This mechanism drives a rotor at a high speed within a processing chamber to pulverize crematory remains that are introduced through a chute or hopper. The pulverized particles fall for collection to an urn or other receptacle below. However, in such a device the high speed of processing generates considerable dust. Dust from pulverized cremation remains poses a health hazard to those in the vicinity, much the same as do fine particles of asbestos. Accordingly, the predominant present practice is to provide a vacuum pump to draw the dust from the pulverization chamber. Nevertheless, a certain amount of dust does escape from the pulverization chamber back up the opening at the feeder chute.

Another disadvantage of pulverizers which are currently available for use in processing crematory remains is that the cremation ashes must first be manually sifted for metal, as the high speed of the rotor will cause damage to the pulverizer mechanism if metal is introduced into the hopper. Some metal is recovered by dragging a magnet through the cremated remains. Stainless steel items, such as pacemaker parts, hip pins and other such articles are recovered in this fashion. On the other hand, a magnet will not recover gold and amalgam tooth fillings or copper or aluminum parts from pacemakers. In any event, metal items are frequently overlooked during the manual sifting process which is necessary prior to processing with conventional devices. When this occurs, the devices are apt to become damaged while pulverizing crematory remains. Moreover, the manual processing is unhealthful because of the dust which is sometimes produced when the cremated remains are disturbed. Furthermore, manual processing is a distasteful procedure to the individual performing it.

Other commercially available devices for processing cremation remains have also been utilized. These include a ball mill pulverizer and a hammer mill pulverizer. However, both of these alternative devices involve the same problems as the rotary pulverizer.

SUMMARY OF THE INVENTION

The present invention is a crematory ash grinder. A stationary bearing plate is positonable within the cylindrical shaft formed within a vertical cylindrical housing. A rotatable grinding plate, perforated by a plurality of apertures, is rotatably positioned beneath the bearing plate and in spaced relation relative thereto. In the operation of the device, the crematory remains are placed within the cylindrical housing atop the grinding disk. The heavy bearing plate is lowered into position into the shaft formed within the housing. An electric motor is actuated to drive the grinding disk in rotation through a speed reducing gear drive. Preferably, the bearing plate includes a plurality of radial ridges or other protuberances so that the crematory remains are held against the bearing plate and ground by the grinding disk. The ground particles of the crematory remains drop through the apertures in the grinding plate into a funnel which is used to channel the ground remains to an urn positioned below.

Because of the relatively low speed at which the grinding disk rotates, very little harmful dust is generated from the crematory remains. In contrast to conventional crematory ash processing devices which involve pulverizing elements moving at speeds of approximately 3500 rpm, the grinding plate of the present invention rotates at a much lower speed of approximately 40 rpm.

Because of the unique arrangement of the bearing plate in the apertured grinding disk, the crematory ash grinder of the present invention automatically separates metal particles of any size from the ashes of bone and other human remains. The holes in the grinding disk are preferably from about ¼ inch to about ⅜ inches in diameter. The great majority of casket screws, hip pins, pacemaker fragments and other metal articles do not pass through the holes in the grinding disk. As a consequence, the crematory ash grinder of the invention automatically separates such metal particles from the ashes of human remains. As a consequence, although it may be desirable to remove metal objects which are readily visible among the crematory remains prior to grinding, no damage to the device results if such objects are processed undetected. The low speed of the grinding and crushing operation and the size of the apertures in the grinding disk readily separate metal particles of any signficant size. These particles remain atop the grinding disk while the ground and crushed ashes of cremation fall into the funnel for collection in an urn below. Such metal particles, while producing some noise in the mechanism, cause no real damage to it and are easily removed when processing is complete.

The invention may be described with greater clarity and particularity by reference to the accompanying drawings.

DESCRIPTION OF THE DRAWINGS

FIG. 1 is a perspective view of the crematory ash grinder of the present invention.

FIG. 2 is a perspective view of the grinding disk and drive mechanism.

FIG. 3 is an elevational view of the mounting for the bearing plate.

FIG. 4 is a sectional elevational view of the crematory ash grinder.

FIG. 5 is an upward plan view of the bearing surface of the bearing plate.

FIG. 6 is a sectional elevational portion of an alternative embodiment of the invention.

DESCRIPTION OF THE EMBODIMENT

FIG. 1 illustrates in perspective a crematory ash grinder 10 which includes an elongated tubular drum or housiing 12 of annular cross section positioned atop a hollow box shaped enclosure 14 therebeneath. A flat, heavy, disk shaped bearing plate 16, formed of steel approximately one inch thick is mounted in cantilever fashion at the upper extremity of the cylindrical housing 12. A perforated horizontal grinding disk 18 depicted in FIG. 2, is mounted for rotation about a foot below the upper extremity of the housing 12 in the cylindrical shaft 20 defined therewithin. The perforated grinding disk 18 is driven by a motor 22, also depicted in FIG. 2, through gears in a gear box 24 and through an upwardly directed vertical axle 26. A large funnel 28, depicted in FIGS. 1 and 4 is located beneath the perforated disk 18 to channel the ground cremation remains falling through the apertures in the grinding disk 18 to an urn 30, or other receptacle positioned beneath it, as depicted in FIG. 4.

The tubular housing 12 is mounted atop the box shaped enclosure 14 by means of L-shaped mounting brackets 32 spaced periodically about the base of the tubular housing 12 on the flat upper surface of the support 14. A short tubular sleeve 34 is welded to the outer surface at the perimeter of the upper extremity of the tubular housing 12. This sleeve receives one leg of an inverted U-shaped cantilever support bar 36, which is utilized to carry the bearing plate 16. The cantilever bar 36 is rotatable about a vertical axis within the tubular sleeve 34. The bearing plate 16 is rotatable about a vertical axis relative to the cantilever support bar 36 at a tubular sleeve 38, the bottom of which is welded to the upper surface of the bearing plate 16. The cantilever bar 36 fits into the sleeve 38 and is longitudinally immobilized therein. The sleeve 38 on the bearing plate 16 rotates relative to the mounting bar 36, which in turn rotates within the sleeve 34. A locking pin 41 fits into a radial aperture in the tubular sleeve 34 beneath the lower extremity of the downwardly depending leg of the cantilever bar 36 residing therein to hold the bearing plate 16 in the elevated orientation depicted in FIG. 1. When the locking pin 41 is withdrawn, the vertical leg of the cantilever bar 36 will slide downwardly within the tubular sleeve 34 and the bearing plate 16, when properly positioned above the opening in the tubular housing 12, can be lowered into the shaft 20.

A pair of upright standards 39 on the upper surface at either side of the bearing plate 16 are joined together near their upper extremities by a transverse lifting rod 40. Another upright center stanchion 42 intersects the lifting rod 40 in T-shaped fashion. The standards 39 and the stanchion 42 are all welded to the bearing plate 16 on its upper surface. Likewise, the lifting bar 40 is welded to the standards 39 and to the stanchion 42. It should be noted that at their upper extremities, the standards 39 turn outward in radially extending tabs 44. Threaded vertical apertures are defined in the tabs 44 to receive adjustment screws 46. When the bearing plate 16 has been lowered into positioned for grinding, as depicted in FIG. 4, the adjustment screws 46 can be further engaged or disengaged relative to the apertures in the tabs 44 to bear against the upper transverse edge 50 of the tubular housing 12 to adjust the spacing between the bearing plate 16 and the grinding disk 18.

The bearing plate 16 is formed with radially inwardly directed notches 52, diametrically opposed from each other and illustrated in FIGS. 1 and 5, at its outer circumference. These notches serve to immobilize the bearing plate 16 from rotation with the grinding disk 18. When the bearing plate 16 is lowered into position in the shaft 20 as indicated in FIG. 4, the notches 52 cooperate with the vertically disposed guide tracks 54, secured to the interior of the shaft 20 on opposite sides of the structure of the tubular housing 12. The bearing plate 16 is thus vertically reciprocal within the shaft 20, but cannot rotate therein because of the interaction of the notches 52 with the tracks 54.

The lower bearing surface 56 of the bearing plate 16 is depicted in plan detail in FIG. 5. This undersurface includes a plurality of radially extending bar-like ridges 58 arranged in a starburst pattern all protruding a uniform distance from the bearing surface 56. The ridges 58 serve to restrain the crematory ashes from being carried in rotation by the rotatable grinding disk 18.

As depicted in FIG. 2, the grinding disk 18 includes a multiplicity of apertures 60 spaced throughout its surface. A central flat head bolt 62 is directed vertically through the grinding disk 18 and into a tapped well in the upper extremity of the vertical axle 26. The grinding disk 18 is keyed to the axle 26, and the axle 26 extends vertically downward through an annular bearing 64. The annular bearing 64 receives lateral support from radially disposed steel bars 66 which are welded thereto and which extend inwardly from the interior surface of the shaft 20. The axle 26 extends downwardly beyond the bearing 64 and passes through a bushing 68 that is supported upon a tubular barrel mounted in a vertical opening in the wall of the funnel 28. The axle 26 thereby resides in snug sliding engagement with the bushing 68.

At the lower extremity of the axle 26 there is a conventional flexible coupling 70. Below that, the axle 26 enters the gear box 24 where gears reduce the speed of an electric drive motor 22 to drive the axle 26 at a slow speed of rotation. The prefered speed is about 40 rpm. The gears within the gear box 24 may be bevel gears arranged in a conventional speed reducing gear arrangement. The motor 22 is a conventional 120 volt a.c. motor which is operated by a switch 76 (FIG. 1) mounted upon the side of the tubular housing 12. The switch 76 is the dial of a potentiometer, so that the speed of rotation of the grinding disk 18 can be varied.

The funnel 28 is mounted with its enlarged open end facing vertically upward immediately below the grinding disk 18 and in abutment with the radial supports 66. The lower end of the funnel 28 converges by empty into the urn 30. The urn 30 may be inserted and removed from the support 14 through a side opening trap door 78 therein.

In the operation of the invention, the bearing plate 16 is lifted by means of the transverse lifting rod 40, and removed from the shaft 20 and held away from the opening defined in the tubular housing 12 by the edge 50 in the fashion depicted in FIG. 1. The locking pin 41 inserted in the tubular sleeve 34 keeps the bearing plate 16 from descending. The cremated remains of a decedent are placed in the shaft 20 atop the grinding disk 18. The bearing plate 16 is rotated relative to the cantilever bar 36, which likewise is rotated relative to the sleeve 34 until the bearing plate 16 is positioned directly above the upper opening of the shaft 20. The locking pin 41 is then removed and the bearing plate 16 is lowered by means of the lifting rod 40 into the shaft 20. Downward movement of the bearing plate 16 is limited by the engagement of the adjusting screws 46 in the tabs 44 as they bear against the edge 50 of the housing 12, as depicted in FIG. 4. The spacing between the grinding disk 18 and the bearing surface 56 of the bearing plate 16 may be altered by manipulation of the adjusting screws 46.

The switch 76 is turned on, thereby bringing electrical power to the motor 22. The motor 22 drives the shaft 26 through the gear box 24 and the flexible coupling 70. The axle 26 rotates the grinding plate 18. Because of the large weight of the bearing plate 16, the bearing plate 16 is pressed downward against the crematory ashes located between the bearing surface 56 and the grinding disk 18. The vertical tracks 54 cooperate with the notches 52 to prevent the bearing plate 16 from rotating. Also, the radial ridges 58 on the bearing surface 56 prevent the crematory ashes from being carried in rotation with the grinding disk 18. Rather, the grinding disk 18 grates the ashes through the apertures 60 therein. These ashes fall downward into the funnel 28 which directs them into the urn 30. The ashes do not escape the funnel 28, since the bushing 68 prevents inadvertent discharge of the ashes through the wall of the funnel 28. When grinding is complete, the urn 30 is removed with the finely ground ashes therein.

It should be noted that any metal objects larger than the apertures 60, and also even smaller articles that become caught in the apertures 60, are sifted from the crematory ashes and are not passed to the urn 30. The diameter of the apertures 60 is preferably between about one quarter and three eighths of an inch. The crematory ash grinder 10 not only crushes and grinds the crematory ashes, but also sifts them from metal objects.

Any metal objects inadvertently placed in the tubular housing 12 are sifted from the crematory ashes and remain atop the grinding disk 18 after grinding and crushing is complete. The bearing plate 16 is removed by pulling directly upward on the lifting rod 40 until the bearing plate 16 emerges from the well 20. Once the cantilever bar 36 has been raised sufficiently relative to the sleeve 34, the locking pin 41 is reinserted to hold the bearing plate 16 in its elevated position. The bearing plate 16 can then be swung sideways to allow removal of any metal objects from atop the grinding disk 18 of FIG. 2. The device is then ready for reuse as described.

It should be understood that numerous variations and modifications of the invention will readily become apparent to others. For example, it is evident that the bearing plate 16 could be rotated relative to the grinding disk 18, rather than effectuating relative rotation in the manner described. Also, differing types of protrusions, other than the radial bars 58, could be employed to the same purpose and effect.

An alternative embodiment of the invention in which the bearing plate 16 is rotated relative to the grinding disk 18 is depicted in FIG. 6. In the embodiment of FIG. 6, the grinding disk 18 is welded or otherwise securely fastened transversely across the tubular housing 12. The bearing plate 16 is mounted at the lower extremity of the axle 26 and the electric drive motor 22 is coupled thereto through the gear box 24. The motor 22 and gear box 24 are carried by the upright standards 39 and the radially disposed steel bars 66 which stabilize the annular bearing 64. The lifting rod 40' is severed and welded or otherwise secured to the casing for the motor 22. The motor 22 thereby drives the bearing plate 16 in rotation while the grinding disk 18 remains stationary. Accordingly, the apparatus should not be limited to the specific implementation described, but rather is defined in the claims appended hereto.

I claim:

1. A crematory ash grinder comprising a vertically oriented cylindrical drum;

a grinding disk mounted coaxially relative to said drum and having a flat surface with multiplicity of apertures therethrough;

a bearing plate mounted coaxially relative to said drum above said grinding disk in spaced relationship thereto and having a downwardly facing flat bearing surface with a plurality of blunt protrusions extending axially a uniform distance therefrom and located across the expanse of said bearing surface;

adjustable means acting between said cylindrical drum and said bearing plate for varying the spacing therebetween;

a funnel positioned beneath said grinding disk for receiving ground ashes emanting through said apertures for collection in an urn located therebeneath;

drive means secured relative to said drum including an electric motor and speed reducing gears for slowly turning one of said grinding disk and said bearing plate in rotation relative to said drum; and a rotation restraining means for immobilizing one of said bearing plate and said grinding disk from rotation relative to said drum.

2. A crematory ash grinder according to claim 1 further characterized in that an axle extends from said grinding disk to said gear train, and an annular bearing surrounds said axle at an intermediate location and lateral support means are provided to immobilize said bearing within said drum.

3. A crematory ash grinder according to claim 2 further comprising a bushing defining an opening in a wall of said funnel, and said axle passes through said bushing in snug sliding engagement therewith.

4. A crematory ash grinder comprising a vertically oriented cylindrical housing defining a shaft, a bearing plate removably positionable across said shaft and having a downwardly facing flat bearing surface with a plurality of blunt protrusions extending axially a uniform distance therefrom located across the expanse of said flat bearing surface, an apertured grinding disk coaxially and rotatably mounted in said shaft beneath said bearing plate and proximate thereto, adjustable means acting between said cylindrical drum and said bearing plate for varying the spacing between said bearing plate and said grinding disk.

drive means secured to said housing for driving said grinding disk and including an electric motor and speed reducing gears, rotation restraining means for immobilizing said bearing plate from rotation relative to said drum, and a funnel located beneath said grinding disk with an enlarged end directed vertically upward and having a constricted end for discharge into an urn removably positioned therebeneath.

5. The crematory ash grinder according to claim 4 further characterized in that said grinding disk includes a multiplicity of vertical apertures located throughout.

6. The crematory ash grinder for claim 5 further characterized in that said apertures are between from about one quarter inch to about three eighths inches in diameter.

7. The crematory ash grinder of claim 4 further characterized in that said bearing plate fits within said shaft and further comprising means for guiding said bearing plate for reciprocal vertical movement into said shaft.

8. The crematory ash grinder according to claim 7 further characterized in that said guiding means includes a plurality of vertical tracks along the walls of said housing engageable with said bearing plate.

9. The crematory ash grinder according to claim 7 further comprising means for attaching said bearing plate to said housing in cantilevered, laterally adjustable fashion, whereby said bearing plate may be withdrawn from said shaft and suspended clear of the shaft opening.

* * * * *